US005092095A

United States Patent [19]

Zadok et al.

[11] Patent Number: 5,092,095

[45] Date of Patent: Mar. 3, 1992

[54] METAL-FACED PANELS HAVING WATER TIGHT JOINTS

[75] Inventors: Yigal Zadok, Daire; Mordechay Anati, Lauderhill, both of Fla.

[73] Assignee: Elite Aluminum Corporation, Pembroke Park, Fla.

[21] Appl. No.: 714,128

[22] Filed: Jun. 11, 1991

[51] Int. Cl.[5] ..... E04C 2/36

[52] U.S. Cl. ..... 52/593; 52/309.9; 52/309.14; 52/802

[58] Field of Search ..... 52/597, 309.9, 589, 52/593, 309.14, 582, 591, 802

[56] References Cited

U.S. PATENT DOCUMENTS

| | | | |
|---|---|---|---|
| 3,535,844 | 10/1970 | Glaros | 52/802 |
| 3,992,839 | 11/1976 | La Borde | 52/802 |
| 4,037,377 | 7/1977 | Howell et al. | 52/309.9 |
| 4,907,383 | 3/1990 | Winter, IV | 52/309.9 |

FOREIGN PATENT DOCUMENTS

| | | | |
|---|---|---|---|
| 1609668 | 1/1973 | Fed. Rep. of Germany | 52/309.9 |
| 1567161 | 5/1980 | United Kingdom | 52/309.9 |

*Primary Examiner*—David A. Scherbel
*Assistant Examiner*—Joanne C. Downs
*Attorney, Agent, or Firm*—Joseph C. Mason, Jr.; Ronald E. Smith

[57] ABSTRACT

Metal-faced structural panels have interlocking edges that include a gutter member so that moisture leaking through a seam cannot penetrate the panels. The interlocked edges are also structurally reinforced and have an overlapped design so that adjacent panels do not flex even when subjected to concentrated loads. The gutter member eliminates the need to apply caulking compound to the seams where continguous panels meet one another. It is formed by bending the sheetmetal that overlies the core of the panels in a reversely bent forty five degree angle at the distal end of a section of sheetmetal that overlies a channel formed in the core. The structural reinforcement is provided by forming a return bend in sheetmetal that overhangs a panel edge and by forming a complementally formed recess in an opposing, interlocking section of sheetmetal.

5 Claims, 4 Drawing Sheets

METAL-FACED PANELS HAVING WATER TIGHT JOINTS

TECHNICAL FIELD

This invention relates, generally, to structural panels of the type used in making roofs and walls. More particularly, it relates to a panel construction resistant to water penetration.

BACKGROUND ART

Structural panels having sheetmetal-covered cores of styrofoam, or other suitable insulating material, are in widespread use. A multitude of different designs have been created and patented; typical prior art designs are shown in U.S. Pat. No. 4,769,963 to Meyerson, U.S. Pat. No. 4,065,902 to Lindal, U.S. Pat. No. 3,228,162 to Gregoiere, U.S. Pat. No. 3,479,784 to Massagli, U.S. Pat. No. 4,438,614 to Raith, et al., U.S. Pat. No. 3,331,173 to Elsner, U.S. Pat. No. 2,284,229 to Palmer, U.S. Pat. No. 4,373,312 to Kim, U.S. Pat. No. 3,367,076 to O,Brien, U.S. Pat. No. 3,742,672 to Schaeufele, and U.S. Pat. No. 4,186,539 to Harmon, et al.

Foreign patents of interest include British patent 1,066,701, British patent 2 168 732A, and French patent no. 2 444 762.

These earlier designs have a common drawback: they leak when used as roofing panels. The complex joint constructions shown in the above-mentioned patents and in many other non-patented designs were intended to provide tight seals against water penetration, but as every owner of a structure having a roof made of metal-faced panels knows, water leaks through the joints of even the most expensive panels.

Leakage occurs, of course, at the seams between contiguous panels. The art teaches that proper application of a good caulking compound at each seam will adequately protect against moisture intrusion; the art also teaches that the panels should not be walked upon after the caulking procedure has been completed because the panels flex at the seams when walked upon and the caulking compound cracks in response to such flexing, especially if the compound is brittle from prolonged solar exposure. Cracked compound, obviously, is pervious to water.

When the teachings and suggestions of the prior art are viewed as a whole in compliance with the requirements of law, those of ordinary skill in this art are impelled to develop better caulking compounds and are repelled from walking on roofs having seams sealed with brittle caulking compound.

DISCLOSURE OF INVENTION

The teachings and suggestions of the prior art relating to the need for improved caulking compounds and the need to avoid walking on the panels after the caulking has been applied are eschewed by the present inventor.

Although the seams of the improved panel construction of this invention can still be caulked, the performance of the compound is no longer critical, even when the panels are walked upon.

The flexing problem is overcome by a unique design that overlaps abutting edges of the sheetmetal that covers the core of the panels; the overlapping inhibits relative movement between the panels. More particularly, a reverse bend is formed in one edge of the sheetmetal to double its thickness, and a corresponding recess is formed in the sheetmetal of a mating panel. The resulting overlap holds the contiguous panels in a horizontal plane even when the panels are walked upon by one or more heavy individuals. Thus, even if the panels have been caulked and the caulking has become brittle, the movement of the panels is too nominal to effect cracking of the compound. The overlapping design also produces a substantially seamless joint, i.e., a zero seam.

The novel design also includes a roll-formed gutter built into the sheetmetal. Thus, if water penetrates the seams, it will be channeled by the built-in gutter to a conventional gutter positioned adjacent the panels. The novel gutter design also serves as a ramp that facilitates interlocking of contiguous panels.

It should now be clear that the primary object of this invention is to revolutionize the art of structural metal-faced panels by providing the first metal-faced panel, anywhere in the world, that is impervious to water penetration even if the seams thereof are not caulked.

A more specific object is to provide an interlocking panel construction that holds contiguous panels in coplanar relation to one another even when concentrated loads are applied thereagainst.

Another specific object is to provide an interlocking panel construction having a built-in gutter that directs water to a conventional gutter before it can seep through a roof formed of interlocked panels.

These and other important objects, features and advantages of this major invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Similar reference numerals refer to similar parts throughout the several views of the drawings.

BEST MODES FOR CARRYING OUT THE INVENTION

Figure 1:
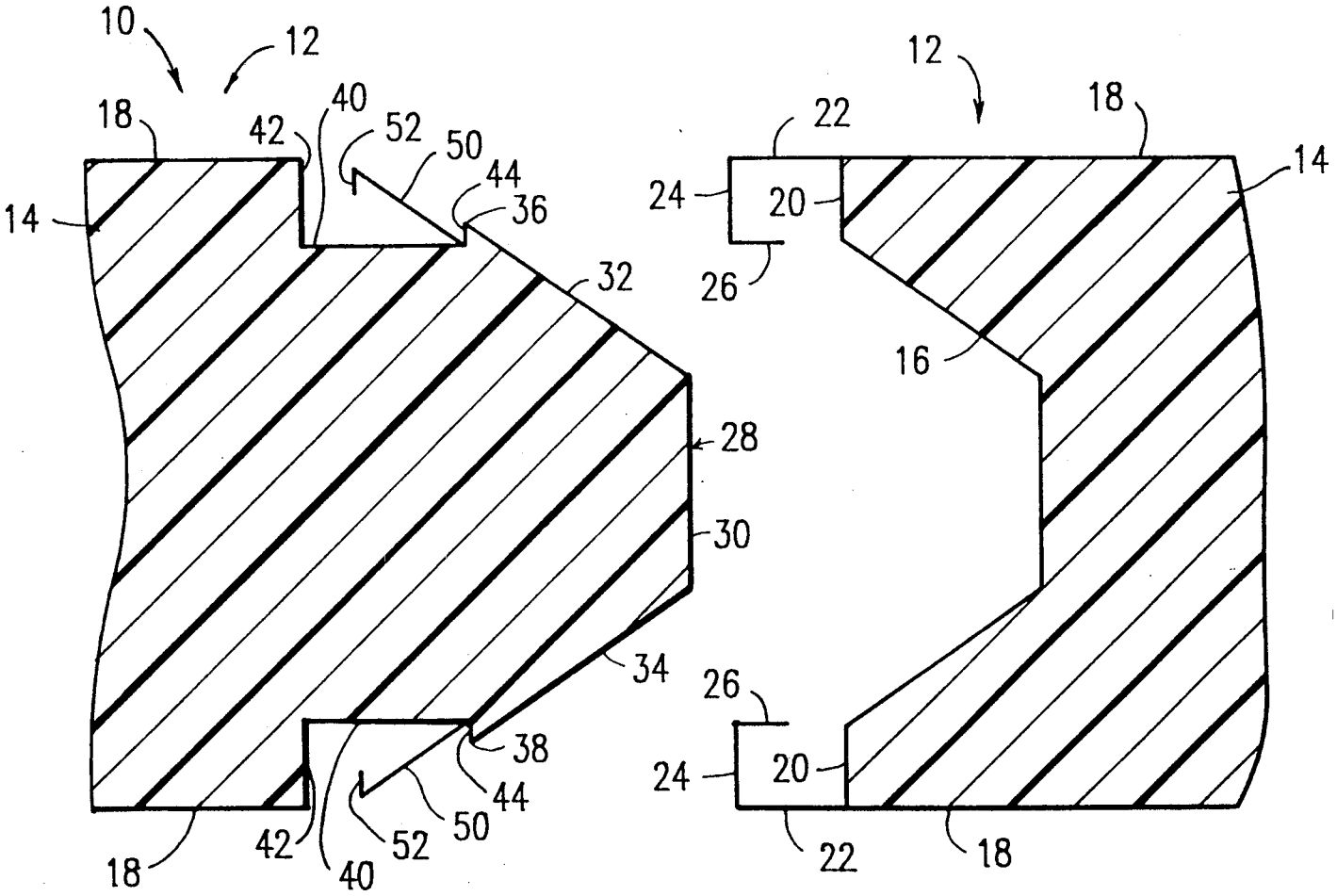
FIG. 1 is a side elevational view showing an embodiment that includes the novel built-in gutter but which does not include the novel design for inhibiting relative movement between the interlocking panels.

Referring now to FIG. 1, it will there be seen that an exemplary embodiment of the invention is denoted as a whole by the reference numeral 10.

The edge of panel 12 at the right hand side of FIG. 1 has a conventional construction and need not be described in detail. Briefly, it includes a core 14 of styrofoam or other suitable material, and a beveled channel 16 is formed in an edge of said core in centered relation with respect to the sheetmetal-covered top and bottom faces of the panel. Sheetmetal 18 is bonded to the opposite faces of core 14, and a first unbent section of said sheetmetal extends a predetermined distance beyond core edge 20 as at 22, a second section is bent ninety degrees a first time as at 24, towards the center of the panel, and a third section is bent ninety degrees a second time, towards the edge 20 of the core of the panel, as at 26.

The edge of panel 12 at the left hand side of FIG. 1 includes the highly novel built-in gutter that obviates the need for sealing panel seams with a sealing compound and thus will be described in detail.

It should be understood from the outset that the edge configuration already described in brief and the edge configuration to now be described in detail are of course formed in opposite edges of the same panel, and that said edges interlock when plural panels are laid in edge-to-edge relation to one another. In the claims that follow, the edge summarily described is referred to as the first edge and the edge that is the subject of the following plenary description is referred to as the second edge.

Figure 5:
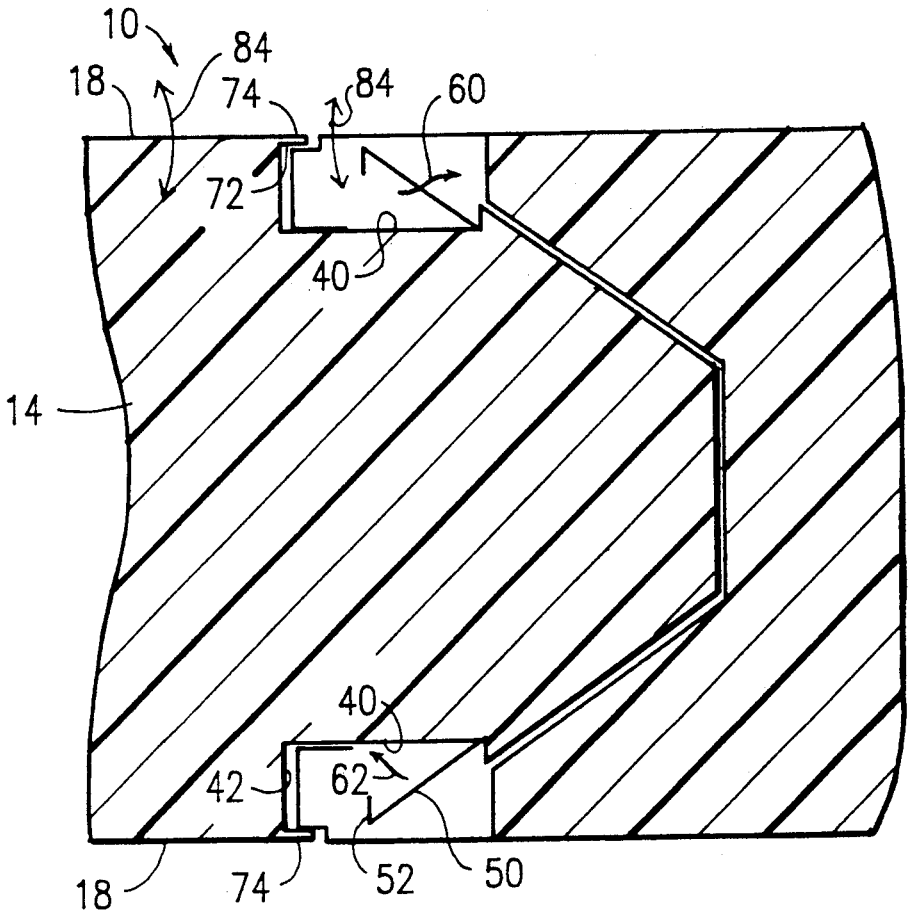
FIG. 5 is a side elevational view similar to FIG. 2, but showing the contiguous panels disposed in interlocked relation to one another.

The second edge of panel 12 includes a beveled protuberance 28 that is configured and dimensioned to mate with the beveled channel 16 formed in the first edge when the novel panels 12 are laid in edge-to-edge relation to one another, as perhaps best understood in connection with FIG. 5; note, however, that FIG. 5 depicts a second embodiment of the invention, to be described hereinafter.

It is important to observe that flat leading edge 30 of protuberance 28 and trailing beveled edges 32, 34 thereof are not covered by sheetmetal; this is in sharp and distinct contrast to earlier designs where said beveled edges are at least in part covered by sheetmetal, thereby teaching away from the present invention.

Beveled edges 32, 34 terminate at their respective trailing ends at points 36, 38, respectively. A three-walled square channel is formed in each opposite face of core 14 inwardly of said points; specifically, each channel includes a flat bottom wall 40, an inward sidewall 42, and a truncate outer sidewall 44 that terminates in its associated point 36 or 38.

Each sheet of sheetmetal 18 overlies its associated top and bottom face of core 14 as aforesaid, bends ninety degrees a first time at said second edge to thereby overlie both inward side walls 42, bends ninety degrees a second time to overlie both bottom walls 40, bends about forty five degrees a first time, at the lowermost end of outer side walls 44 and in a reverse direction, to thereby form gutter 50, and bends forty five degrees a second time towards the center of the panel, i.e., towards the opposing face of the panel, to form strengthening lip 52. All of the bends are made by roll forming sheetmetal in accordance with conventional techniques.

Gutter 50 and lip 52 were heretofore unknown; in earlier designs, the sheetmetal 18, after bending ninety five degrees a first and second time as described above, bends ninety degrees a third time to overlie outer side wall 44 and bends about forty five degrees towards the second edge, i.e., in overlying relation to at least part of beveled edges 32, 34; thus, in said earlier designs, there is no reverse bending and hence no gutter. In the novel design, there is no covering of outer side wall 44 and no covering of beveled edges 32, 34.

Figure 6:
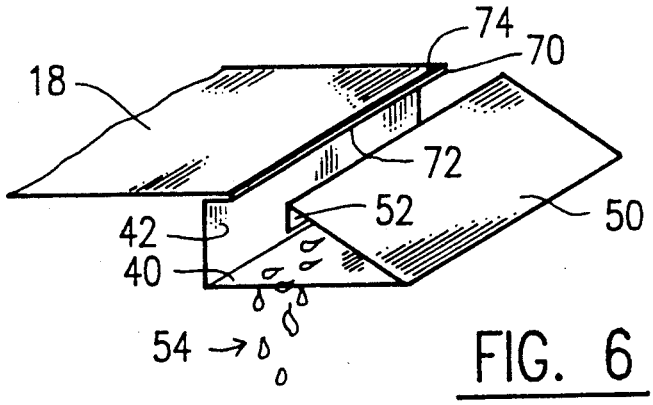
FIG. 6 is a perspective view of a sheetmetal facing having the novel built-in gutter roll-formed therein.

The efficacy of gutter 50 is perhaps best understood in connection with FIG. 6; note that said gutter provides a barrier to water 54 and constrains it to flow in a longitudinal direction into a conventional gutter, not shown, that is installed adjacent the novel roof panels. In the earlier designs, as perhaps best understood in connection with FIG. 5, water accumulates in the square channel having bottom wall 40 and bounded by side walls 42 and 44 and eventually overflows side wall 44 as indicated by the arrow denoted 60 in FIG. 5. Thus, said water enters into the crack between the abutting pieces of core material, i.e., the small space between protuberance 28 and channel 16; that water then leaks into the space defined by the interlocking sheetmetal joints and since said joints are not water tight, the water then makes its way into the space beneath the roof panels by following the path denoted by the arrow 62 at the bottom of FIG. 5.

Of course, the water flow depicted by arrows 60 and 62 in FIG. 5 cannot occur in the novel panels due to the provision of gutter or barrier means 50. The absence of water flow as depicted by arrow 60 means that there can be no water flow as depicted by arrow 62 as well. The provision of gutter 50 is a pioneering breakthrough in the art because it eliminates the need to caulk the seams; penetrating water is simply channeled by gutter 50 to the conventional gutter and no leakage can occur. Caulking may still be used if desired, but its use is no longer critical.

The embodiment of FIG. 1 does not address the problem of flexing and the concomitant breaking of a caulked seal if the roof is walked upon or otherwise subjected to concentrated loads. This problem is solved in the embodiment depicted in FIGS. 2–5.

Figure 2:
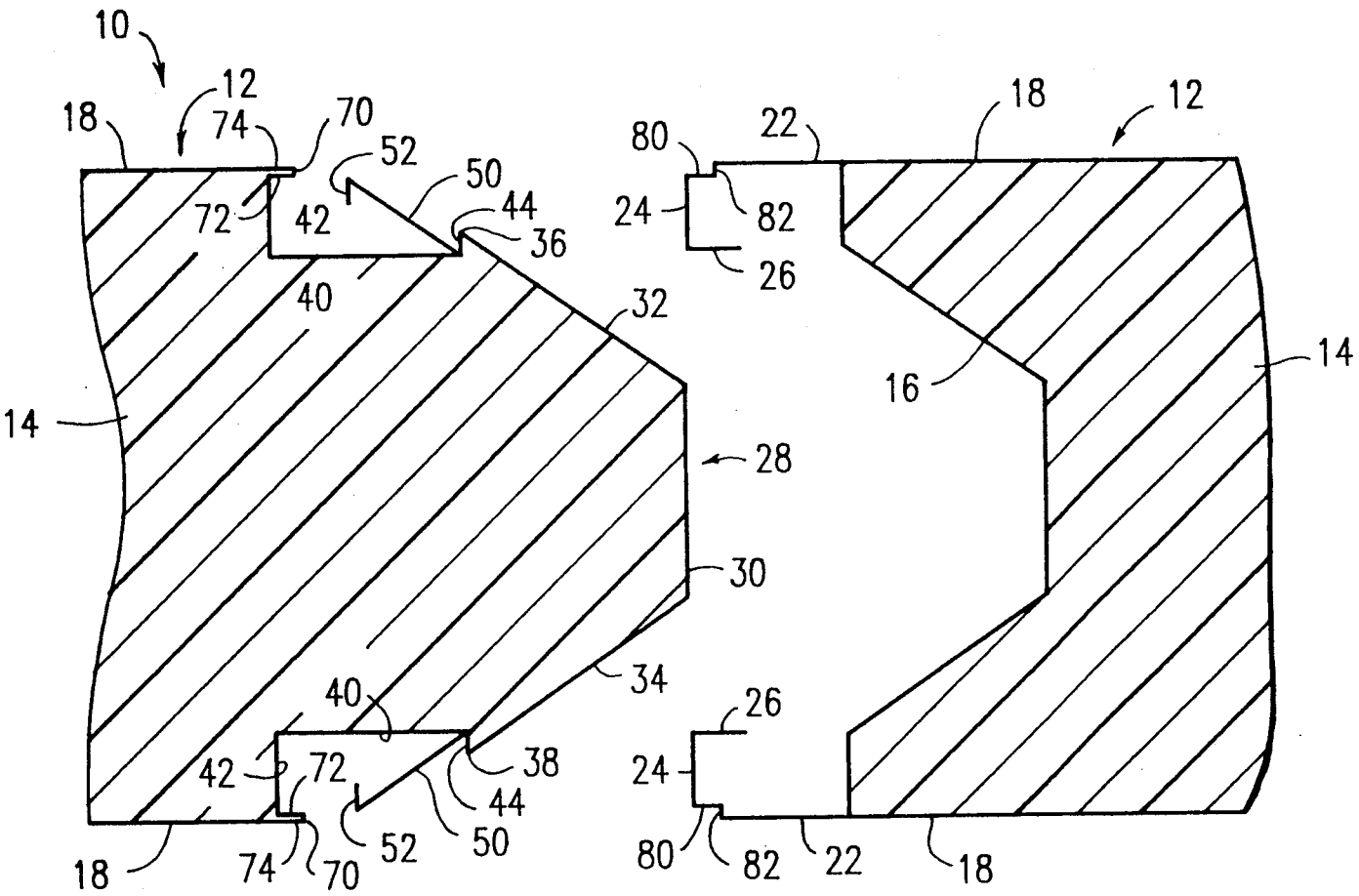
FIG. 2 is a side elevational view of contiguous panel edges including both the novel built-in gutter and the means for inhibiting relative movement between said contiguous panels.

Whereas sheetmetal 18 was roll formed into a first ninety degree bend in the embodiment of FIG. 1 to overlie inner side wall 42, said sheetmetal extends beyond said inner side wall in the embodiment of FIG. 2 and has a return bend formed therein as at 70; the sheetmetal returns to inner side wall 42, as at 72, and then forms a first ninety degree bend to overlie said side wall 42. The remaining part of said sheetmetal follows the path of travel already described in connection with FIG. 1.

The return bend part of said sheetmetal, i.e., the part of said sheetmetal that extends beyond the second edge of the panel, is denoted 74 and will hereinafter sometimes be referred to as a lip. In a commercial embodiment of the novel structural panels, the extent of lip 74 will be about one fourth inch (about two-thirds centimeter); it serves to strengthen and reinforce the sheetmetal edge and is an important part of the anti-flexing means of this invention.

Referring now to the right hand side of FIG. 2, it will there be seen that lip 74 is received within a complementally formed recess 80 formed in extensions 22 and 24 of sheetmetal 18; the mating between said lip and recess is depicted in FIG. 5. The depth of recess 80, indicated by the reference numeral 82 in FIG. 2, is substantially equal to the thickness of lip 74 so that the exterior surface of lip 74 is coplanar with sheetmetal 18 when the panels are interlocked with one another as shown in FIG. 5. It has been found that the above-mentioned quarter inch overlap between the panel interlocking means, as is achieved when lip 74 is received within recess 80, prevents the panels from flexing even when they are walked upon. More precisely, movement represented by the double-headed directional arrows collectively denoted 84 in FIG. 5 is not possible when lip 74 is fully received within recess 80. Thus, even brittle caulking compound will not fail when the novel panels are walked upon because there can be no substantial relative movement between the interlocked panels.

Figure 3:
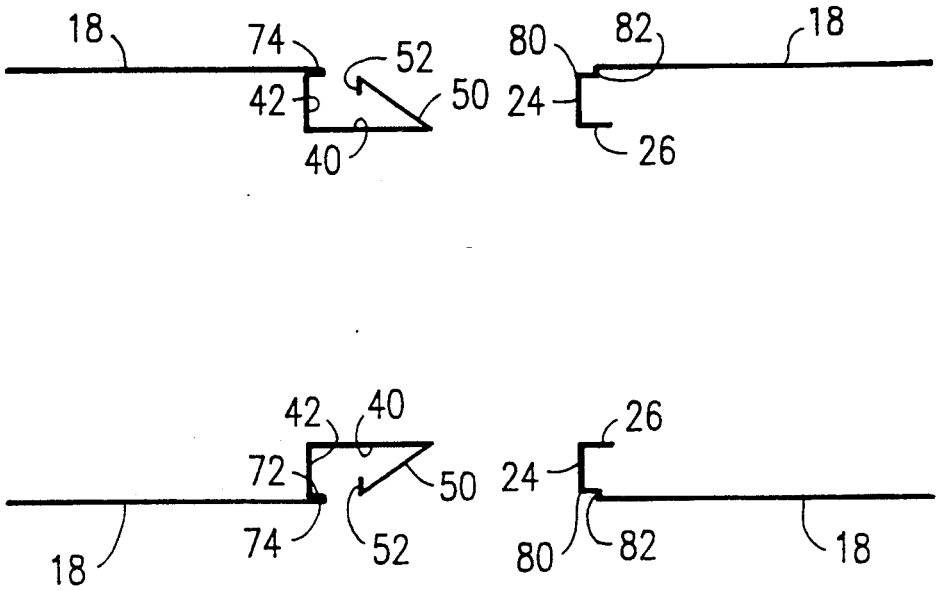
FIG. 3 is a side elevational view of the embodiment shown in FIG. 2, but with the core of the panels removed to better depict the sheetmetal part thereof.
Figure 4:
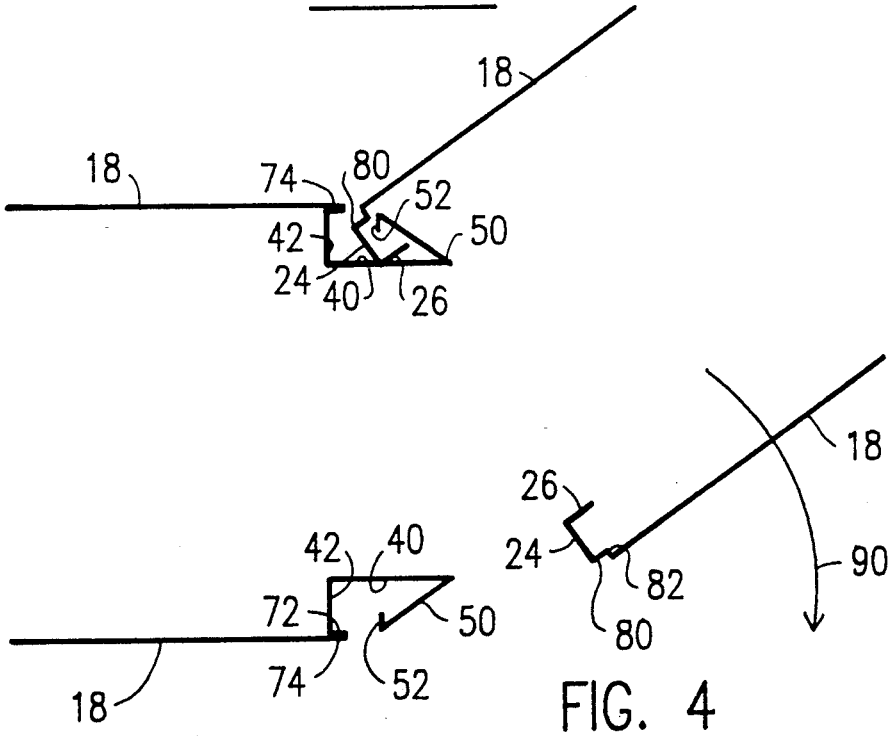
FIG. 4 is a side elevational view similar to FIG. 3, but showing how the panels are interlocked.

The technique employed in interlocking contiguous panels is depicted in animated sequence in FIGS. 3-5. The panels are first brought into proximity with one another as depicted in FIG. 3 and one of the panels is tilted about fifteen degrees from the horizontal as shown in FIG. 4 as it is brought into engagement with the already-installed horizontal panel on the left side of said Figs. The tilted panel is then rotated as indicated by the directional arrow 90 in FIG. 4 until the position of FIG. 5 is attained. Note that gutter 50 has sufficient yieldability to flex as required as the parts are assembled and sufficient resiliency to regain its initial position after the assembly has been completed.

This invention is clearly new and useful. Moreover, it was not obvious to those of ordinary skill in this art at the time it was made, in view of the prior art when considered as a whole in accordance with the requirements of law.

This invention pioneers the art of interlocking structural panels that require no caulking compound to seal the seams thereof. Accordingly, the claims that follow are to be broadly interpreted to protect from piracy the heart or essence of this breakthrough invention.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A structural panel of the type having a core with opposed flat faces covered with sheetmetal, said panel further having opposed edges adapted to engage associated edges of contiguous structural panels, comprising:

a first edge of said core having a beveled channel formed therein;

each face of said panel having a first unbent section of sheetmetal that extends a predetermined distance past the first edge of said core, a second section bent ninety degrees relative to said first section in a direction toward an opposing face of the panel, and a third section bent ninety degrees relative to said second section in a direction toward said first edge;

a second edge having a beveled protuberance formed therein that is complementally formed with respect to said beveled channel;

a square channel formed in each opposed face of said beveled protrusion, adjacent the beveled surfaces thereof;

said square channel including a first inner wall, a second outer wall, and a bottom wall that interconnects said first and second walls at a lowermost end thereof;

said sheetmetal being bent ninety degrees toward an opposed face to overlie said first wall, being bent ninety degrees toward said second edge to overlie said bottom wall, and being reversely bent about forty five degrees at the lowermost end of said second wall to form a gutter means having a common extent with said square channel.

2. The panel of claim 1, wherein said sheetmetal that is reversely bent is further bent about forty five degrees toward an opposing face of the panel to form a lip that strengthens the gutter means.

3. A structural panel of the type having a core with opposed flat faces covered with sheetmetal, said panel further having opposed edges adapted to engage associated edges of contiguous structural panels, comprising:

a first edge of said core having a beveled channel formed therein;

each face of said panel having a first unbent section of sheetmetal that extends a predetermined distance past the first edge of said core, a second section bent ninety degrees relative to said first section in a direction toward an opposing face of the panel, and a third section bent ninety degrees relative to said second section in a direction toward said first edge;

a second edge having a beveled protuberance formed therein that is complementally formed with respect to said beveled channel;

a square channel formed in each opposed face of said beveled protrusion, adjacent the beveled surfaces thereof;

said square channel including a first inner wall, a second outer wall, and a bottom wall that interconnects said first and second walls at a lowermost end thereof;

said sheetmetal that covers the opposed flat faces of said panel including a return bend section that extends beyond said second edge by a predetermined distance, a section contiguous to said return bend section that is bent ninety degrees at said second edge toward an opposed face to overlie said first wall, another section bent ninety degrees toward said second edge to overlie said bottom wall, and another section that is reversely bent about forty five degrees at the lowermost end of said second wall to form a gutter means having a common extent with said square channel.

4. The panel of claim 3, further comprising a recess formed in said sheetmetal associated with the first edge of the panel in that unbent part of said sheetmetal that extends beyond said first edge, said recess having a thickness substantially equal to the thickness of said return bend part of said sheetmetal.

5. The panel of claim 4, wherein said sheetmetal that is reversely bent is further bent about forty five degrees toward an opposing face of the panel to form a lip that strengthens the gutter means.

* * * * *